United States Patent [19]

DeMoss et al.

[11] 4,151,857

[45] May 1, 1979

[54] GAS LIFT VALVE

[75] Inventors: Edward E. DeMoss; William A. Dudley, both of Garland, Tex.

[73] Assignee: Teledyne Industries, Inc., Los Angeles, Calif.

[21] Appl. No.: 780,311

[22] Filed: Mar. 23, 1977

[51] Int. Cl.[2] ..... F04F 1/08

[52] U.S. Cl. ..... 137/155; 417/112

[58] Field of Search ..... 137/155; 417/112

[56] References Cited

U.S. PATENT DOCUMENTS

| | | | |
|---|---|---|---|
| 2,982,226 | 5/1961 | Peters | 417/112 |
| 3,417,774 | 12/1968 | Douglas | 137/155 |

*Primary Examiner*—Alan Cohan

*Attorney, Agent, or Firm*—Gerald G. Crutsinger; Larry B. Dwight

[57] ABSTRACT

A gas lift valve for use in a continuous flow operation which has an externally biased bellows which is pressurized internally to open the valve. A noncompressible liquid surrounds the bellows and flows upwardly through a passage about the valve stem into a dome in the valve which is pressurized to a predetermined pressure to resist movement of the bellows and opening of the valve. Fluid passes through a series of labyrinth rings formed on the valve stem adjacent the passage into the dome to dampen valve movement. An O-ring seal on the valve stem below the passage into the dome engages and seals off the passage if excessive pressure expands the bellows to a predetermined point such that the bellows will be protected from rupture by the noncompressible liquid trapped about the bellows. A snubber ring of nonmetallic material is positioned about the lower end of the valve stem to limit lateral movement of the valve ball in the seat. A travel limit spring in the pressure chamber between the valve stem and the housing and is compressed to limit upward movement of the valve stem. A throttling spring exerts upward pressure on the valve stem to reduce valve hysteresis and minimize the pressure differential across the bellows. The throttling spring and bellows work together with the valve ball and seat assembly to cause a reduced gas flow through the valve as the tubing pressure reduces. The reaction of the throttling spring and bellows facilitates the even, continuous flow of the gas.

22 Claims, 8 Drawing Figures

GAS LIFT VALVE

BACKGROUND

Gas lift valves are used primarily in oil well production for injecting gas into the fluid to be produced lifting the fluid to the surface without pumping.

The well generally has a well tubing with a casing surrounding the well tubing. Side pockets are formed on the tubing with passages communicating with the well casing. Gas lift valves are positioned in the side pockets to control flow through the passage formed between the casing and tubing such that when the casing is pressurized, pressure will be released into the tubing at a predetermined rate to aerate the fluid therein to raise it to the surface.

Heretofore, the general practice has been to employ a bellows diaphragm in the valve which is internally biased to allow pressure to act against the sides of the diaphragm to open the valve or to use an externally biased diaphragm such that the well casing pressure expands the diaphragm and opens the valve. When utilizing high pressures in the range of 2,000 psi the pressure often causes premature failure of the bellows. A rupture of the bellows requires that the valve be repaired or replaced and considerable production is lost for significant length of time. In addition, a direct actuation of the bellows causes significant variations in the opening and closing of the valve because of the varying pressure in the well. Vertical vibrations cause horizontal movement of the valve ball relative to the seat causing excessive wear on valve ball and seat. Vertical vibrations of the valve stem also cause additional lateral vibrations of the stem, causing excessive valve chatter and premature failure of the valve.

SUMMARY OF INVENTION

A gas lift valve comprising a casing having a dome formed in the upper end thereof and an inlet at the lower end thereof. The valve ball is connected to a hollow valve stem having a passage formed longitudinally thereof which communicates with the inlet at the lower end of the casing and the interior of a flexible bellows. The bellows is secured at one end to the valve casing and at the other end to the valve stem. Pressure from the gas in the well casing enters the valve casing and passes through the hollow bore of the stem and outward through passages in the wall thereof into the interior of the bellows causing the stem to rise upwardly as the bellows expands. The bellows is positioned in the chamber formed in the bore of the casing having a sealed lower end about the stem and filled with a noncompressible fluid. As the bellows extends, the fluid passes upwardly into a dome chamber formed at the upper end of the casing and compresses a nitrogen gas charge contained within the dome chamber. A throttling spring aids in urging the valve stem upwardly. The ball of the valve seats on a frusto-conical seat communicating with the interior of the well tubing such that when the valve is open the casing pressure aerates the fluid in the well tubing.

When excessive casing pressure enters the valve casing and expands the bellows upwardly, the stem travels upwardly until a seal formed in an annular groove about the stem engages the passage through which the noncompressible fluid passes to seal the passage and traps the fluid about the bellows. A limiter spring limits upward movement of the ball to keep the ball in a throttling position above the seat when casing pressures are in the normal operating range. But when the casing pressure is excessive, the limiter spring allows continued upward travel of the bellows until the seal formed in an annular groove about the stem engages the passage through which the noncompressible fluid passes to seal the passage and trap the fluid about the bellows.

A snubber ring is positioned just above the valve ball on the stem in an annular groove formed thereabout which resists lateral movement of the valve stem to prevent chattering of the valve ball in the valve seat.

The primary object of the invention is to provide a gas lift valve which will accommodate high gas volumes and high pressure requirements without damaging the bellows of the valve.

A further object of the invention is to provide a valve which proportionately controls the gas volume entering the well for changes in production of fluids.

A further object of the invention is to provide apparatus to prevent over extension of the bellows which would damage the bellows and destroy the usefulness of the valve.

A further object of the invention is to provide a valve which eliminates lateral chatter and attendent fluctuations in desired flow rate which automatically centers the ball with the seat when assembled with subsequent seating cycles, retains the central position during travel off of and onto seat and thus reduces wear on the valve ball and valve seat, thus assuring a longer valve life and minimizing operational costs.

A still further object of the invention is to provide a valve in which the operating differential pressure across the bellows is minimized in order to apply the valve in very high pressure environment.

DESCRIPTION OF THE DRAWINGS

Drawings of a preferred embodiment of the invention are annexed hereto so that the invention may be better and more fully understood, in which.

DESCRIPTION OF A PREFERRED EMBODIMENT

Figure 1:
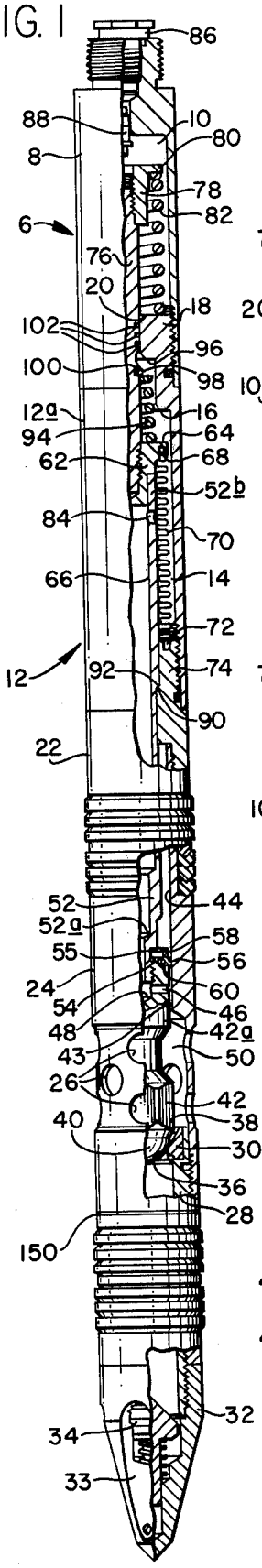
FIG. 1 is an elevational view of the gas lift valve in the closed position with parts broken away to more clearly illustrate the details of construction.
Figure 2:
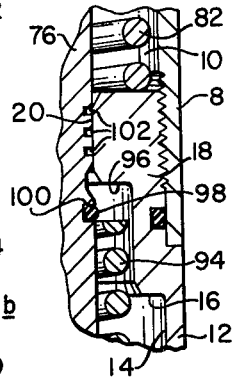
FIG. 2 is an enlarged cross-sectional view of the bellows protector seal and labyrinth rings with the valve in closed position.

Referring to FIG. 1 of the drawing, gas lift valve 6 generally comprises a segmented casing having an upper section 8 forming a dome chamber 10 therein which is threadedly secured to a first center section 12 having a chamber 14 formed therein. The upper portion of the first center portion 12 has a shoulder 16 formed internally adjacent a divider member 18 which forms a passage 20 between the chamber 14 and dome chamber 10. A second center section 22 joins the first center section 12 with the inlet thimble section 24 by a threaded connection. Inlet thimble section 24 has apertures 26 formed therein for communicating with the chamber 50 formed in section 24. Valve seat casing 28 is threadedly secured to the lower end of the inlet thimble 24 for securing the valve seat 30 to the valve 6. Bottom cap 32 is threadedly secured to the valve seat casing 28 and contains a back check valve 34 for preventing back flow of fluid from the well tubing (not shown) into the well casing.

Seat 30 is positioned in an annular shoulder 36 on the upper end of valve seat casing 28 and comprises a cone shaped surface 38 which tapers to the port area of seat 30 and is generally constructed of a hardened material such as tunsten carbide. Seat 30 mates with a valve element such as ball 40 comprising a semi-circular design preferably of tungsten carbide on the end of a ball head 42 which engages the port area of the seat 30. The ball 40 and seat 30 are designed to maintain the ball 40 in seat 30 throughout normal travel of ball 40.

The upper end 42*a* of ball head 42 is slideably disposed in bore 44 formed longitudinally through the casing. A passage 46 communicates between the bore 44 of the casing and a counterbore 48 formed in the upper end of the valve head 42. Bore 44 communicates with a chamber 50 formed adjacent apertures 26 in inlet thimble casing 24 to allow passage of pressurized gas from the well casing into chamber 50, through the lower portion 43 of bore 44, through passage 46 into counterbore 48 of valve head 42. It should be readily apparent that a clearance should be allowed between the outer circumference of the upper end 42*a* of valve head 42 and bore 44 of the casing.

A hollow valve stem 52 is threadedly secured in internally threaded counterbore 48 in the upper end 42*a* of valve head 42. A shoulder 54 is formed on the lower end 52*a* of hollow stem 52 which engages stem extender washer 55 which limits movement of washer 58 positioned concentrically on the external side of the extender washer 55 and the internal surface of bore 44 of the casing. Washer 58 retains snubber washer 56 within annular shoulder 60 on the upper end 42*a* of valve head 42. The washer 58 retains the snubber 56 to limit vertical movement of snubber 56 relative to the stem. Snubber 56 is a ring having an internally formed slot therein which communicates with a torus passage in the ring. This allows a resiliency in the upper and lower surface of snubber 56 which urges the internal ring against the upper and lower shoulder to limit lateral movement of the snubber 56 and stem 52 in bore 44. Snubber 56 is preferably constructed of a smooth, hard, plastic material such as polytetrafluoroethylene (TFE) or other fluoroplastics such as Teflon® manufactured by E. I. duPont de Nemours and Company, Inc., Wilmington, Del. This prevents excessive friction as the ball moves up and down and has sufficient friction with the upper end 42*a* of ball head 42 and annular shoulder 60 to prevent lateral oscillation of the ball 40 in the seat 30 as the ball moves up and down.

Figure 5:
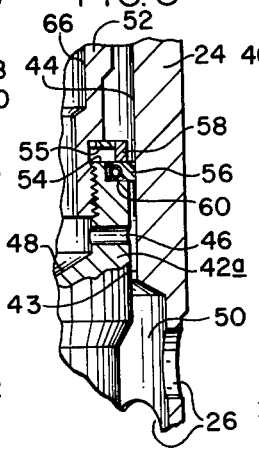
FIG. 5 is an enlarged cross-sectional view illustrating the lateral snubber.
Figure 6:
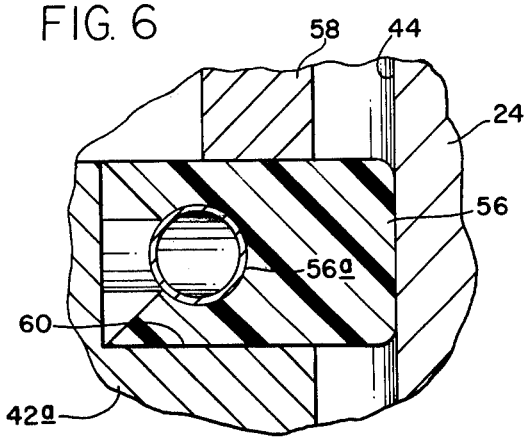
FIG. 6 is an enlarged sectional view of the snubber.

Referring to FIGS. 5 and 6 of the drawings, lateral movement of valve ball head 42 is controlled by snubber 56. Snubber 56 comprises a resilient ring having a spring 56*a* formed of spring like material which exerts an outward radial pressure against the snubber 56 to urge snubber 56 against bore 44.

During assembly of the valve 6, ball head 42 is introduced into the bore 44 and seat 30. The ball 40 will normally contact only one side of the seat 30. Snubber 56 is urged against the wall of bore 44. As the ball 40 moves down after initial contact with the seat 30 to a fully seated position shown in FIG. 1, the ball 40 will contact both sides of seat 30 and snubber 56 will be positioned in its groove between shoulder 60 and washer 58. This forces the snubber 56 into this groove and centers the ball 40 within bore 44. As the ball 40 and ball head 42 move upwardly, snubber 56 retains its position in bore 44 and the groove formed between shoulder 60 and washer 58, because of friction which exceeds the force of random lateral forces from gas flow, therefore maintaining the ball 40 centered relative to the longitudinal axis passing through head 42 and seat 30.

The upper end 52*b* of hollow stem 52 is secured to an annular end piece 62 having a flange 64 formed outwardly therefrom. Stem 52 has a bore 66 formed therethrough. Flange 64 has an annular groove 68 to which the upper end of bellows diaghragm 70 is secured. The flexible bellows diaphragm is secured at the lower end in groove 72 formed on the upper shoulder 74 of second center section 22 of the casing. The upper shoulder 74 of second center casing 22 and the flange 64 comprise the upper and lower ends of chamber 14. A clearance is formed between the outer circumference of flange 64 and chamber 14 to allow passage of a noncompressible fluid, to be hereinafter described, above flange 64. Stem 76 is threaded secured in the counterbore formed in end piece 62. A spring nut 78 having a flange 80 thereon is secured to the upper end of stem 76. Throttling spring 82 is secured between flange 80 of spring nut 78 and the upper surface of divider member 18 to aid in lifting stem 76 upwardly to lift ball 40 off of seat 30. Passages 84 formed in the upper end 52*b* of hollow stem 52 communicate with the interior cavity of the bellows 70. A noncompressible fluid, such as Dow-Corning 200 having a viscosity of 20 centistrokes plus water, is placed in chamber 14 and allowed to flow upwardly through passage 20 into the dome chamber 10. A top plug 86 is threadedly secured to the upper end of dome casing 8 having a valve 88, such as a Dill valve core, secured therein to allow charging of the dome chamber 10 with a pressurized gas such as nitrogen.

Downward movement of valve head 40 and hollow stem 52 is limited by an outwardly extending shoulder 90 which engages an inwardly extending shoulder 92 formed in the upper shoulder 74 of second center section 22 of the casing.

Means to limit upward movement of the valve ball 40 comprises a travel limiter spring 94 positioned between the upper surface of end piece 62 and the inner shoulder 96 of divider member 18. O-ring 98 is secured in groove 100 such that as the stem 76 moves upwardly the O-ring will engage the inner surface of passage 20 to prevent further movement of the noncompressible liquid upwardly into dome chamber 10 and trap same about bellows 70 to protect same against damage by excessive pressure. Means to dampen movement of fluid from chamber 14 to dome chamber 10 comprises 3 annular grooves 102 forming labyrinth rings with passage 20.

Operation of the hereinbefore described valve is as follows:

Valve 6 is placed in a side pocket provided either inside or outside the tubing communicating with the casing annulas adjacent an aperture communicating with the well tubing as well known in the art. Prior to insertion into a well, the valve dome chamber 10 is charged with a predetermined pressure of gas through valve 88 located in top plug 86 to bias the valve ball 40 closed. This creates a bias pressure on the noncompressible fluid outside the bellows which creates a pressure on the bellows 70.

Figure 3:
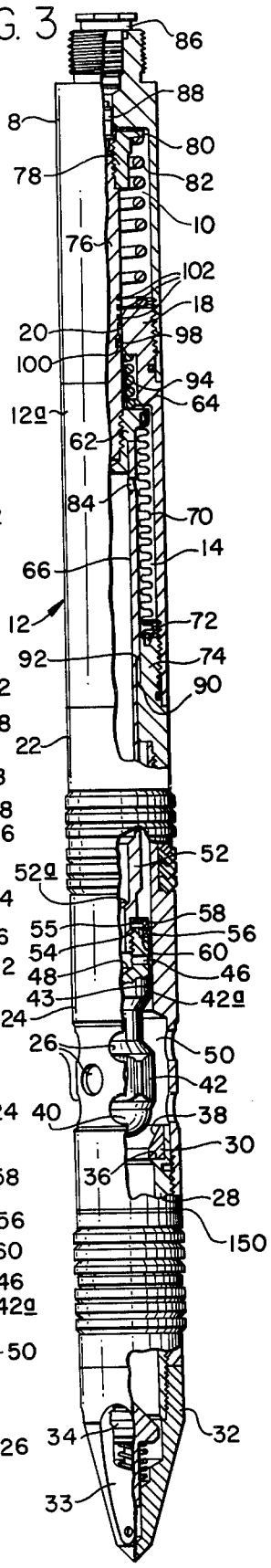
FIG. 3 is an elevational view of the gas lift in the open position with parts broken away to more clearly illustrate the details of construction.
Figure 4:
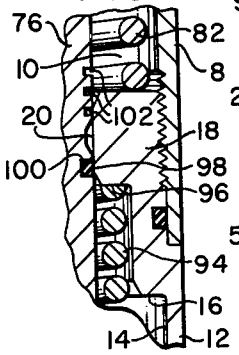
FIG. 4 is an enlarged cross-sectional view of the bellows protector seal and labyrinth rings with the valve in the open position.

Once the valve 6 is in the well sufficient pressure is applied from the casing annulus to overcome the charge in the dome 10 and bellows chamber 14. Such pressure enters through apertures 26 formed in inlet thimble casing 24 and flows through passage 46, into counterbore 48, and through bore 66 formed in hollow stem 52. The pressure flows out passage 84 into the interior cavity of the bellows 70. The gas pressurizes the bellows 70 and causes the bellows to be expanded upwardly within chamber 14 to lift stem 52, ball head 42 and valve ball 40 off of seat 30. This allows pressurized gas to flow through check valve 34 in the hollow openings 33 formed in bottom cap 32 into the well tubing to permeate the fluid in the tubing with gas to lift same to the surface. If the well becomes clogged or for any reason the pressure in the well casing increases substantially, bellows 70 will expand upwardly until the upper end of limiter spring 94 engages shoulder 96 on divider member 18 as best illustrated in FIGS. 3 and 4. In addition, O-ring 98 will engage the wall of passage 20 and seal therewith, forming an upper seal in chamber 14. When stem 52 moves a predetermined distance, O-ring 98 seals passage 20 to prevent further movement of the noncompressible fluid through passage 20 between the stem 76 and divider member 18 to prevent further expansion and movement of the bellows 70 and prevent damage thereto. Any additional pressure applied to the bellows 70 will be transferred to the noncompressible liquid which will limit outward radial expansion of the bellows 70. In addition, the labyrinth grooves 102 are positioned such that the lower groove 102 remains in passage 20 of divider member 18.

It should be readily apparent that a throttler spring 82 acts against the pressure within dome 10 which biases the valve 6 closed. This creates a smoother more desirable characteristic of the open valve since variations in the pressure would cause the valve ball 40 to bounce in seat 30. It is the arrangement between the throttling spring 82 urging the valve open and bellows that reduces the hysteresis of the valve. If the spring force helped to close the valve, then the hysteresis of the valve becomes larger. The throttling spring 82 must be of sufficient stiffness to resist movement due to minor intermittent pressure fluctuations.

Figure 8:
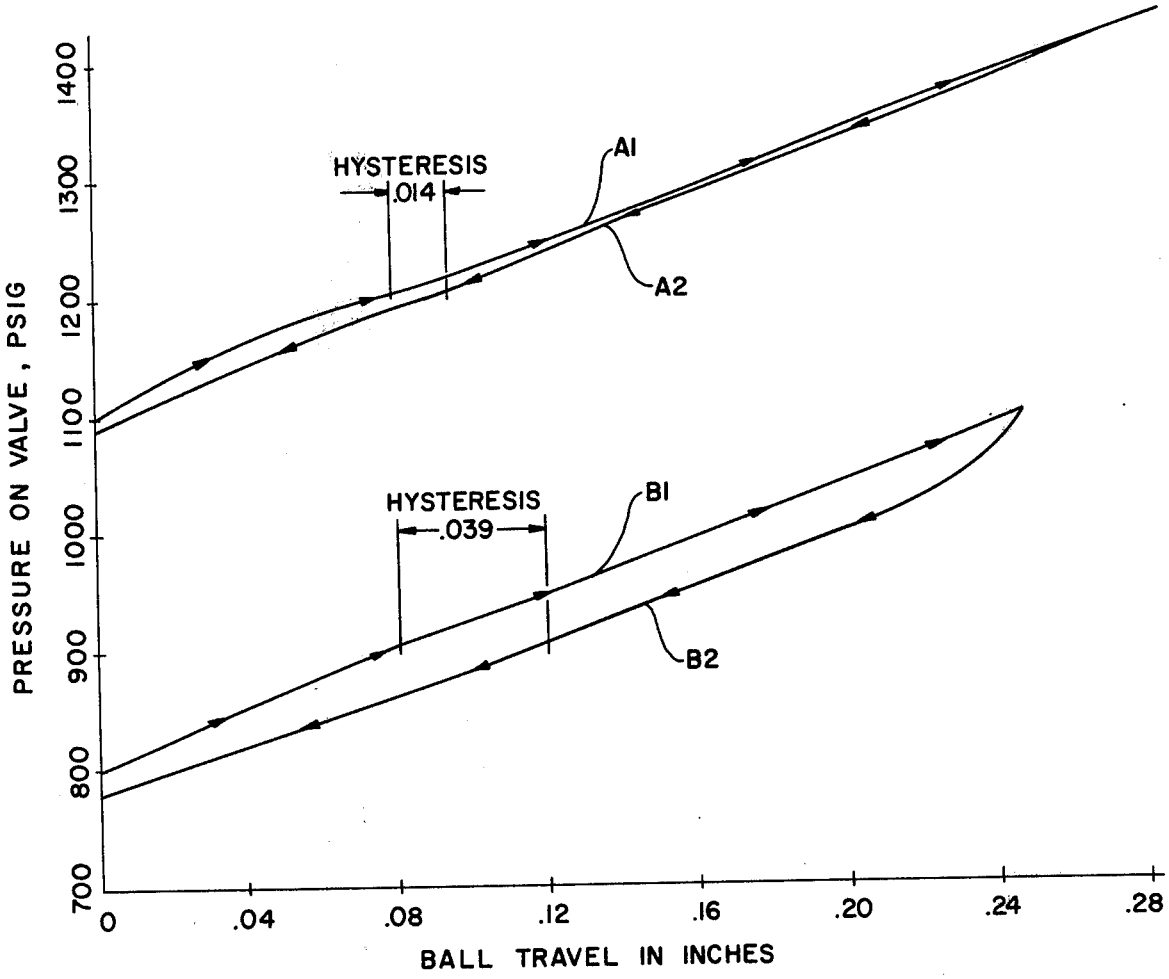
FIG. 8 is a graph showing valve hysteresis.

Tests show that in utilizing throttling spring 82 to aid in opening the valve 6, instead of closing the valve, valve hysteresis is reduced. Referring to FIG. 8 of the drawings, the graph illustrates the vertical movement of the valve ball 40 relative to seat 30 as the pressure varies. Lines A1 and B1 show movement on increasing pressure and lines A2 and B2 show movement on decreasing pressure. The hysteresis is the difference in movement of the ball 40 when increasing and decreasing pressure is equal or the lag between the line A1 or B1 and A2 or B2. Lines A1 and A2 show a valve aided by throttling spring 82 to open the valve ball 40. Lines B1 and B2 illustrate test results on a valve where a spring aids in closing the valve. As is readily apparent from the graph showing static probe test of actual valves, the hysteresis is one-half for a valve having a throttling spring 82 to aid in opening the valve than for one closing the valve even when measured at a higher pressure where hysteresis is even a greater problem.

Figure 7:
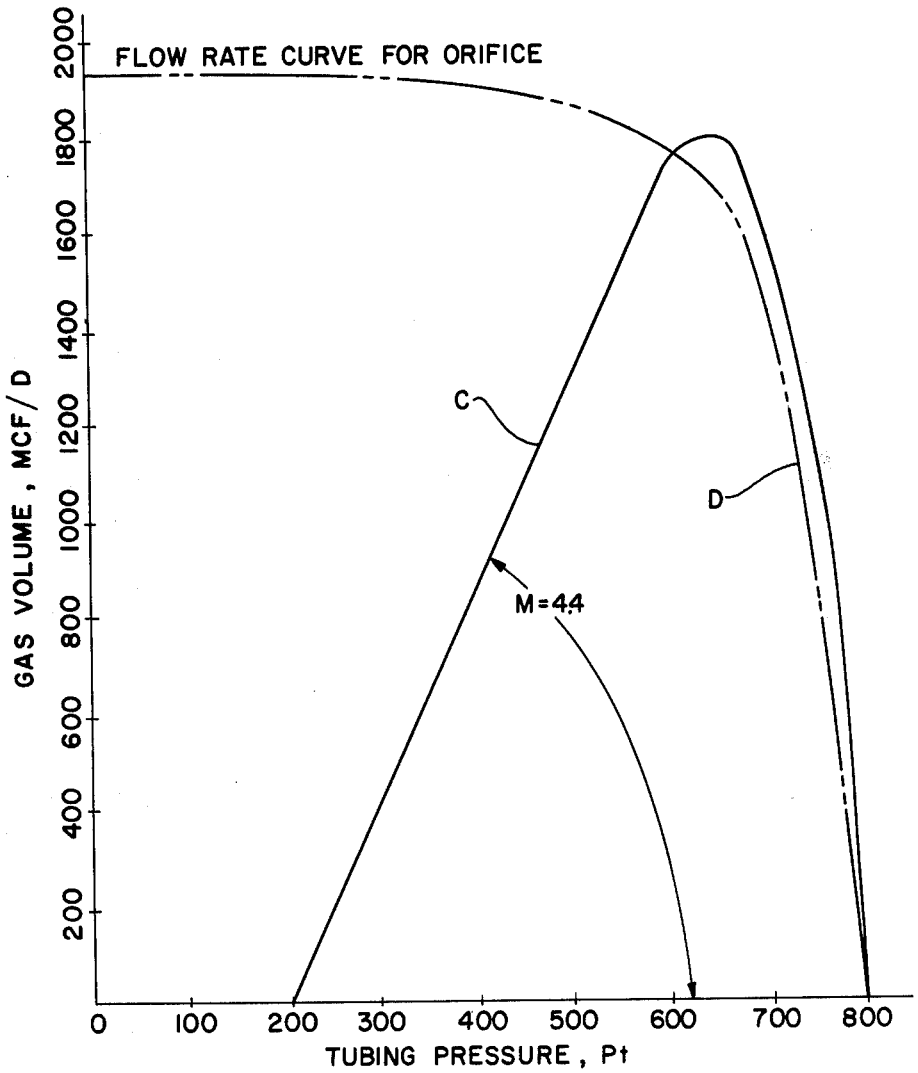
FIG. 7 is a graph showing flow rates versus tubing pressure.

The throttling characteristics of the valve are obtained by the combination of the valve ball 40 and seat 30 in combination with the throttling spring 82. The gas flow rate of the valve 6 is related to the throttling characteristics of the valve. As illustrated by the graph in FIG. 7, the flow rate through the valve, shown by solid line C, decreases as the pressure differential across the valve 6 increases. This is opposite to the flow rate through the orifice, shown by dashed line D, which increases as the pressure differential across the orifice increases.

As the pressure expands bellows 70, forcing the noncompressible fluid through the passage 20 into dome 10, the pressure in dome 10 becomes greater, therefore further limiting the travel of ball 40 out of seat 30. Seat 30 has a conical surface 38 which forms an annular ring of space between the ball and seat when the valve is opened which is shaped similar to the frustrum of a cone. When ball 40 is approximately 0.100 inches off of the seat the cone frustrum is small as compared to the port area of the seat 30. When the ball 40 is 0.200 inches off of the seat 30 the area increases substantially and when the ball 40 is 0.300 inches off the seat 30 the area of the cone frustrum is greater than the area of the seat port and therefore further movement of ball 40 is not necessary to increase the flow of gas through the valve because valve throttling would be lost. Therefore means to limit upward travel of ball 40 relative to seat 30 comprises a travel limiter spring 94. Control of the travel distance of ball 40 is adjusted by adjusting ring 150 which is positioned between the shoulders on inlet thimble section 24 and valve casing section 28 to adjust the relative height of seat 30 relative the ball 40.

When dealing with high pressures in wells, a great amount of vibration can occur when the pressures are trying to stabilize, and therefore it is necessary to provide a dampening effect on the movement of the ball laterally to prevent undue wear on the valve seat 30 and ball 40. Snubber 56 provides lateral restraint on the valve head 42 within bore 44 of the casing to prevent undue wear on the valve 6. The noncompressible liquid, such as the silicone fluid, is dampened by the labyrinth grooves 102 formed in the stem 76 which further reduces the vertical vibration of stem 76 and thus ball 40 in seat 30.

From the foregoing it should be readily apparent that the invention hereinbefore described accomplishes the objects of the invention.

It should be appreciated that other and further embodiments of the invention may be devised without departing from the basic concept thereof.

Having described our invention, we claim:

1. A gas lift valve having a casing with a bore formed longitudinally therethrough, said bore being closed at one end, a divider member extending inwardly from the casing into the bore to divide the upper portion of the bore into a dome chamber and a bellows chamber, forming a passage through the divider member between the chambers; a valve stem extending through the bore of the casing and through the passage between the dome and bellows chamber; a valve seat secured in the lower portion of the valve casing; a valve element secured to said valve stem and adapted to close said valve seat, the improvement comprising: a bellows diaphragm between said valve stem and said casing in said bellows chamber, the interior cavity of said bellows diaphragm communicating with the exterior of said casing; a noncompressible fluid disposed in said bellows chamber about said bellows diaphragm and adapted to flow into said dome chamber through the passage in said divider, said dome chamber being pressurized to exert pressure through the fluid therein onto the bellows diaphragm to compress same and urge the valve stem and valve element downwardly to close the valve; means secured on said valve stem adjacent said passage in said divider adapted to seal the passage between the dome chamber and the bellows chamber when the pressure inside the bellows diaphragm exceeds a predetermined amount and moves the bellows diaphragm upwardly a predetermined distance, the fluid in the bellows chamber being trapped about the exterior of the bellows diaphragm to prevent rupture of the diaphragm; and a throttling spring disposed between the casing and the upper end of the valve stem arranged to urge the valve toward the open position.

2. In a gas lift valve, a housing, a dome chamber and a bellows chamber in the housing with a passage communicating therebetween; a valve stem moveable through the passage; a valve passage in the housing; a valve head on the stem arranged to control flow through the valve passage; ports through the wall of the housing communicating with the valve passage; a bellows diaphragm in the bellows chamber surrounding the stem and secured between the stem and the housing with the exterior of the bellows communicating with the dome chamber; a predetermined charge of fluid under pressure in the dome chamber arranged to compress the bellows to urge the valve head to closed position; a passage through the valve stem communicating with the ports and the interior of the bellows; a quantity of noncompressible liquid in the bellows chamber about the bellows arranged to flow into the dome chamber when the bellows is expanded; and a seal about the stem arranged to engage the passage between the dome and bellows chamber to trap the noncompressible fluid about the bellows.

3. In a gas lift valve, a housing having a hollow bore therethrough, said housing further having a dome chamber and a bellows chamber formed in said housing with a passage communicating therebetween; a valve stem moveable through said passage between said dome chamber and bellows chamber; a frustroconical valve seat secured at one end of said housing having a port formed therethrough; a valve head having a round valve ball secured thereto secured to said valve stem and arranged to control the flow through said valve seat port; ports formed in the wall of the housing communicating with the interior of the bore above the valve seat; a bellows diaphragm in said bellows chamber surrounding said stem secured between the stem and the housing; the exterior of said bellows communicating with the dome chamber, and the interior of said bellows communicating with the passage formed in the valve stem which communicates with the ports in said housing; a travel limiter spring secured between said valve stem and said housing adapted to limit upward movement of said valve stem to open said valve seat; a throttling spring adapted to aid in urging said valve stem upward to open said valve port seat, said throttling spring having sufficient stiffness to overcome variations in pressure which would cause vertical vibration of said valve stem and head; a predetermined charge of fluid under pressure in the dome chamber and bellows chamber arranged to compress the bellows to urge said valve head to a closed position; a quantity of noncompressible liquid in said bellows chamber about said bellows arranged to flow into said dome chamber when the bellows is expanded; a seal secured about the stem arranged to engage the passage between the dome chamber and the bellows chamber to trap the noncompressible fluid about the bellows diaphragm and protect the bellows diaphragm from further expansion; a ring of non-metallic material positioned about said stem adjacent the valve head, said ring being urged outwardly to engage the hollow bore of the housing to limit lateral movement of said valve head relative to the valve seat such that the ring reduces lateral movement and wear on said valve seat, and the travel limiter spring limits upward movement of said ball past maximum opening in the valve seat and said valve being aided in opening by said throttling spring which reduces vertical vibration and hystersis of said valve to reduce wear of the valve seat and ball.

4. A gas lift valve having a casing with a bore formed longitudinally therethrough, said bore being closed at one end, a divider member extending inwardly from the casing into the bore to divide the upper portion of the bore into a dome chamber and a bellows chamber, forming a passage through the divider member between the chambers; a valve stem extending through the bore of the casing and through the passage between the dome and bellows chamber; a valve seat secured in the lower portion of the valve casing; a valve element secured to said valve stem and adapted to close said valve seat, the improvement comprising: a bellows diaphragm between said valve stem and said casing in said bellows chamber, the interior cavity of said bellows diaphragm communicating with the exterior of said casing; a noncompressible fluid disposed in said bellows chamber about said bellows diaphragm and adapted to flow into said dome chamber through the passage in said divider, said dome chamber being pressurized to exert pressure through the fluid therein onto the bellows diaphragm to compress same and urge the valve stem and valve element downwardly to close the valve; means secured on said valve stem adjacent said passage in said divider adapted to seal the passage between the dome chamber and the bellows chamber when the pressure inside the bellows diaphragm exceeds a predetermined amount and expands the bellows diaphragm upwardly a predetermined distance, the fluid in the bellows chamber being trapped about the exterior of the bellows diaphragm to prevent rupture of the diaphragm; and labyrinth grooves formed in the stem adjacent said passage in the divider member such that the fluid must flow through the grooves as it flows through the passage to dampen the flow of fluid from the bellows chamber to the dome chamber to reduce vertical vibration of the valve stem.

5. The combination called for in claim 4 wherein the means secured on the valve stem adjacent the passage within the divider comprises: an O-ring disposed in a groove formed in the valve stem, said O-ring adapted to engage the interior wall of said passageway to seal off the passage to prevent flow of fluid from the bellows chamber to the dome chamber.

6. The combination called for in claim 4 with the addition of a nonmetallic guide ring disposed about the lower portion of the valve stem adapted to engage the bore formed in the casing to resist lateral movement of the valve stem relative to the bore in the casing.

7. The combination called for in claim 6 wherein the guide ring comprises a ring conformed of a fluoroplastic resin which is urged against the valve stem to reduce lateral movement between the casing and the valve stem.

8. The combination called for in claim 4 wherein the fluid comprises a composition of water and silicone fluid.

9. A gas lift valve having a casing with a bore formed longitudinally therethrough, said bore being closed at one end, a divider member extending inwardly from the casing into the bore to divide the upper portion of the bore into a dome chamber and a bellows chamber, forming a passage through the divider member between the chambers; a valve stem extending through the bore of the casing and through the passage between the dome and bellows chamber; a valve seat secured in the lower portion of the valve casing; a valve element secured to said valve stem and adapted to close said valve seat, the improvement comprising: a bellows diaphragm between said valve stem and said casing in said bellows chamber, the interior cavity of said bellows diaphragm communicating with the exterior of said casing; a noncompressible fluid disposed in said bellows chamber about the said bellows diaphragm and adapted to flow into said dome chamber through the passage in said divider, said dome chamber being pressurized to exert pressure through the fluid therein onto the bellows diaphragm to compress same and urge the valve stem and valve element downwardly to close the valve; means secured on said valve stem adjacent said passage in said divider adapted to seal the passage between the dome chamber and the bellows chamber when the pressure inside the bellows diaphragm exceeds a predetermined amount and expands the bellows diaphragm upwardly a predetermined distance, the fluid in the bellows chamber being trapped about the exterior of the bellows diaphragm to prevent rupture of the diaphragm; a throttling spring disposed between the casing and the upper end of the valve stem arranged to urge the valve toward the open position; and a limiter spring in the bellows chamber between the valve stem and the casing arranged to limit upward movement of the valve stem within normal operating pressures.

10. In a gas lift valve, a housing, a dome chamber and a bellows chamber in the housing with a passage communicating therebetween; a valve stem moveable through the passage; a valve passage in the housing; a valve head on the stem arranged to control flow through the valve passage; ports through the wall of the housing communicating with the valve passage; a bellows diaphragm in the bellows chamber surrounding the stem and secured between the stem and the housing with the exterior of the bellows communicating with the dome chamber; a predetermined charge of fluid under pressure in the dome chamber arranged to compress the bellows to urge the valve head to closed position; a passage through the valve stem communicating with the ports and the interior of the bellows; a quantity of noncompressible fluid in the bellows arranged to flow into the dome chamber when the bellows is expanded; a seal about the stem arranged to engage the passage between the dome and bellows chamber to trap the noncompressible fluid about the bellows; and a plurality of labyrinth grooves formed about the stem arranged to dampen the flow of fluid through the passage between the dome and the bellow chamber and thereby eliminate vertical vibration of the stem.

11. In a gas lift valve, a housing, a dome chamber and a bellows chamber in the housing with a passage communicating therebetween; a valve stem moveable through the passage; a valve passage in the housing; a valve head on the stem arranged to control flow through the valve passage; ports through the wall of the housing communcating with the valve passage; a bellows diaphragm in the bellows chamber surrounding the stem and secured between the stem and the housing with the exterior of the bellows communicating with the dome chamber; a predetermined charge of fluid under pressure in the dome chamber arranged to compress the bellows to urge the valve head to closed position; a passage through the valve stem communicating with the ports and the interior of the bellows; a quantity of noncompressible fluid in the bellows chamber about the bellows arranged to flow into the dome chamber when the bellows is expanded; a seal about the stem arranged to engage the passage between the dome and bellows chamber to trap the noncompressible fluid about the bellows; and a guide ring secured about the valve stem adjacent the valve head arranged to engage the bore of the casing to limit lateral movement of the valve head in the seat.

12. In a gas lift valve, a housing, a dome chamber and a bellows chamber in the housing with a passage communicating therebetween; a valve stem moveable through the passage; a valve passage in the housing; a valve head on the stem arranged to control flow through the valve passage; ports through the wall of the housing communicating with the valve passage; a bellows diaphragm in the bellows chamber surrounding the stem and secured between the stem and the housing with the exterior of the bellows communicating with the dome chamber; a predetermined charge of fluid under pressure in the dome chamber arranged to compress the bellows to urge the valve head to closed position; a passage through the valve stem communicating with the ports and the interior of the bellows; a quantity of noncompressible fluid in the bellows chamber about the bellows arranged to flow into the dome chamber when the bellows is expanded; a seal about the stem arranged to engage the passage between the dome and bellows chamber to trap the noncompressible fluid about the bellows; and a spring secured in the dome chamber between the casing and the upper end of the valve stem arranged to urge the valve toward an open position.

13. In a gas lift valve, a housing, a dome chamber and a bellows chamber in the housing with a passage communicating therebetween; a valve stem moveable through the passage; a valve passage in the housing; a valve head on the stem arranged to control flow through the valve passage; ports through the wall of the housing communicating with the valve passage; a bellows diaphragm in the bellows chamber surrounding the stem and secured between the stem and the housing with the exterior of the bellows communicating with the dome chamber; a predetermined charge of fluid under pressure in the dome chamber arranged to compress the bellows to urge the valve head to closed position; a passage through the valve stem communicating with the ports and the interior of the bellows; a quantity of noncompressible fluid in the bellows chamber about the bellows arranged to flow into the dome chamber when the bellows is expanded; and a seal about the stem arranged to engage the passage between the dome and bellows chamber to trap the noncompressible fluid about the bellows; and a limiter spring about the housing arranged to limit upward movement of the valve stem within normal operating pressures.

14. A variable gas lift valve in the well comprising: a casing with a bore formed longitudinally therethrough, a divider member extending into said bore to form a dome chamber and bellows chamber, and a valve seat having a passage communicating with the well; a stem extending through the bore of the casing and through said divider member, said stem further having grooves formed thereon adjacent said divider member; a valve element secured to said stem and adapted to close said passage in said valve seat; a bellows diaphragm secured between said stem and said casing, the interior of said diaphragm communicating with the pressure in the well, said pressure from the well will expand the diaphragm to open the valve; a noncompressible fluid disposed in the bellows chamber about the bellows diaphragm; a pressurized gas in said dome chamber adapted to resist movement of said noncompressible fluid into said dome chamber, said fluid movement further resisted by said grooves, the movement of said stem and valve element being a function of the well pressure and dome pressure such that said valve element moved from said valve seat to control the rate of flow of the well fluid through the valve.

15. The combination called for in claim 1 wherein said valve element comprises: a ball having tapered sides; and said valve seat has tapered sides to receive the tapered sides of said valve ball.

16. The combination called for in claim 10 wherein said valve head comprises: a valve element having tapered sides; and said passage bore tapered sides to receive said valve element.

17. A valve according to claim 11, wherein said guide ring comprises: a ring having a torus passage formed on the internal side thereof; a spring positioned in said torus passage to urge said ring outwardly to engage the interior wall of said housing; and means frictionally engaging said ring to limit movement of said ring relative to the longitudinal axis of the stem, said means frictionally engaging said ring further preventing lateral movement of the stem relative to the bore of the housing until the valve head engages the valve seat.

18. The combination called for in claim 4 wherein said valve element comprises: a ball having tapered sides; and said valve seat has tapered sides to receive the tapered sides of said valve ball.

19. The combination called for in claim 9 wherein said valve element comprises: a ball having tapered sides; and said valve seat has tapered sides to receive said tapered sides of said valve ball.

20. The combination called for in claim 11 wherein said valve head comprises: a valve element having tapered sides; and said passage bore having tapered sides to receive said valve element.

21. The combination called for in claim 12 wherein said valve head comprises: a valve element having tapered sides; and said passage bore having tapered sides to receive said valve element.

22. The combination called for in claim 13 wherein said valve head comprises: a valve element having tapered sides; and said passage bore having tapered sides to receive said valve element.

* * * * *